United States Patent [19]

Schueler

[11] Patent Number: 4,766,629

[45] Date of Patent: Aug. 30, 1988

[54] VENTILATED FLOTATION MATTRESS

[76] Inventor: Tyler E. Schueler, 30 Winchester Dr., Huntington, Conn. 06484

[21] Appl. No.: 56,713

[22] Filed: Jun. 2, 1987

[51] Int. Cl.[4] ..... A47C 27/10

[52] U.S. Cl. ..... 5/451; 5/455; 5/468

[58] Field of Search ..... 5/451, 450, 452, 455, 5/449, 457, 422, 468

[56] References Cited

U.S. PATENT DOCUMENTS

| | | | |
|---|---|---|---|
| 529,852 | 11/1894 | Brupbacher et al. | 5/449 |
| 1,576,211 | 3/1926 | O'Kane | 5/455 |
| 2,731,652 | 1/1956 | Bishop | 5/455 |
| 3,089,153 | 5/1963 | Bosc | 5/455 |
| 3,253,861 | 5/1966 | Howard | 5/468 |
| 3,705,429 | 12/1972 | Nail | 5/455 |
| 3,766,579 | 10/1973 | Shields | 5/451 |
| 4,501,036 | 2/1985 | Santo | 5/452 |
| 4,513,463 | 4/1985 | Santo | 5/452 |
| 4,534,078 | 8/1985 | Virsturs et al. | 5/451 |
| 4,611,357 | 9/1986 | Chelin | 5/451 |

FOREIGN PATENT DOCUMENTS

| | | | |
|---|---|---|---|
| 3535374 | 4/1987 | Fed. Rep. of Germany | 5/455 |
| 331459 | 7/1958 | Switzerland | 5/457 |
| 787421 | 12/1957 | United Kingdom | 5/457 |

*Primary Examiner*—Alexander Grosz

*Attorney, Agent, or Firm*—Sixbey, Friedman, Leedom & Ferguson

[57] ABSTRACT

The flotation mattress includes an outer cover which defines an enclosed inner area divided into three sequential sections by transverse dividing walls. Each section includes alternating water columns and ventilation chambers arranged across the section between raised air baffles extending along the outer longitudinal edges of each section. The water columns are of maximum cross-sectional area adjacent the top surface of the mattress and of minimal cross-sectional area adjacent the bottom surface of the mattress. The intervening ventilation chambers are open to the atmosphere and are of minimal cross-sectional area adjacent the top surface of the mattress.

18 Claims, 3 Drawing Sheets

VENTILATED FLOTATION MATTRESS

BACKGROUND OF THE INVENTION

Technical Field

The present invention relates to mattresses generally, and more particularly to a novel and improved lightweight flotation mattress designed to reduce the surface pressure that is created when a patient is confined on the mattress for long periods of time, or for burn patients.

Bedridden patients in hospitals, nursing homes, and in home care situations often develop decubitus ulcers as a result of their confinement. In an attempt to prevent the formation of decubitus ulcers or bed sores, a number of flotation mattresses have been designed to provide enhanced support for bedridden patients. A large number of these flotation mattresses embody water flotation systems providing a type of support which permits bed sores to be successfully treated and healed. However, water flotation mattresses have been subject to a number of disadvantages which have proven difficult to overcome. For example, most of these mattresses require special supporting frames capable of sustaining the weight of a water-filled flotation mattress. Consequently, such flotation mattresses are either not designed for use on conventional hospital beds, or when such use is possible, adversely affect the operation of the hosptial beds. The normal hospital bed is not designed to accept the weight of both a conventional water-filled flotation mattress in addition to the weight of the patient, and such mattresses are not capable of flexing with a hospital bed when it is moved to a raised position.

In the past, attempts have been made to lower the weight of a water-filled flotation mattress so that the mattress can be supported on a hosptial bed. For example, U.S. Pat. No. 3,848,282 to E. A. Viesturs discloses a lightweight flotation mattress wherein tie strips internally positioned within the mattress limit the amount of water needed to fill the mattress and, thus, the mattress weight. Also, U.S. Pat. Nos. 4,534,078 to Viesturs et al, 4,501,036 and 4,513,463 to Santo disclose water-filled mattresses having peripheral air chambers. With portions of the mattress being filled with pressurized air, the overall weight is somewhat reduced.

Also, U.S. Pat. No. 3,766,579 to Shields discloses a water bed having a compartmentalized air beam structure combined with a water mattress. This structure is of less weight than a similar structure completely filled with water, as is the flotation mattress shown by U.S. Pat. No. 4,517,692 to Vogel which incorporates a foam frame in combination with a water-filled mattress structure.

Although these prior art flotation mattress structures have, to some extent, successfully reduced the overall flotation mattress weight, the structures are still often quite heavy.

A universal problem with known flotation mattresses is the lack of ventilation provided to the patient supported thereby. Since these mattresses must be formed from waterproof material, there is no opportunity for air to pass through the mattress and reach the patient. The failure to ventilate the patient's body offsets, to some degree, the beneficial action of flotation mattresses in treating or preventing decubitus ulcers. Some early attempts were made to provide ventilation compartments within water-filled mattresses, as illustrated by U.S. Pat. No. 529,852 to Brupbacher, but enclosed ventilation compartments of the type shown by this patent having little access to the outside atmosphere are only minimally effective.

DISCLOSURE OF THE INVENTION

From the foregoing, it will be appreciated that there is a need for a flotation mattress which is both light in weight and flexible, while providing a combination of the enhanced support of a water-filled unit while effectively ventilating the body of a patient using the mattress. It is a primary object of this invention to provide such a flotation mattress.

Another object of the present invention is to provide a novel and improved flotation mattress having a combination of internal water-filled chambers, chambers filled with pressurized air, and ventilation chambers which are open to the atmosphere. These chambers are arranged within three separate mattress sections which are relatively pivotal to permit the mattress to flex with a hospital bed which is moved to a raised position.

Yet another object of the present invention is to provide a novel and improved flotation mattress having alternating water-filled and ventilation chambers which are arranged longitudinally of the mattress and which extend alternatively across the width of the mattress. The water-filled chambers are designed so as to provide maximum fluid support of the patient at the upper surface of the mattress while the intervening ventilation chambers are formed to have maximum exposure to the atmosphere at the bottom surface of the mattress.

A further object of the present invention is to provide a novel and improved flotation mattress wherein movement and motion discomfort are controlled by raised sides and an internal I-beam and special baffle construction. Reinforced I-beam panels extending across the width of the mattress and between the upper and lower panels thereof provide enhanced stability for the mattress. Three individual pressurized air baffles arranged longitudinally on each side of the mattress cradle the patient within the center water-supported portion of the mattress.

A still further object of the present invention is to provide a novel and improved flotation mattress which provides the advantage of water support for a patient in combination with enhanced undermattress and patient body ventilation which is provided by internal ventilation chambers. The patient is positioned on the mattress by longitudinal air-filled baffles which rise above the mattress surface and which, with the ventilation chambers and the design of special water-filled chambers, minimize the operative weight of the mattress.

These and other objects of the present invention are achieved by forming a flotation mattress from an elongated top and bottom panel which are joined to a side panel extending around the periphery of the mattress. Internally, the mattress is divided into three sections by I-beam shaped reinforcing panels which extend transversely across the width of the mattress and join the top panel to the bottom panel. Each of these three internal mattress sections includes longitudinally extending baffles or air chambers on opposite sides thereof which, when filled with air, extend above the remainder of the surface of the top panel. The mattress sections also include longitudinally extending ventilation chambers and water-filled columns which alternate across the width of the mattress between the spaced air-filled baffles. Preferably, the water-filled columns are of maximum cross-sectional area adjacent the top panel of the mattress and of minimum cross-sectional area adjacent the bottom panel, while the ventilation chambers have a minimum cross-sectional area adjacent the top panel and a maximum cross-sectional area adjacent the bottom panel. These ventilation chambers have ventilation holes which open through the top panel between the water columns, and the ventilation chambers are open at the bottom panel of the mattress. All of the water-filled columns within a section of the mattress are joined by transversely extending water ducts so that all columns within a section may be filled from a single nozzle assembly for that section.

BEST MODE FOR CARRYING OUT THE INVENTION

Figure 1:
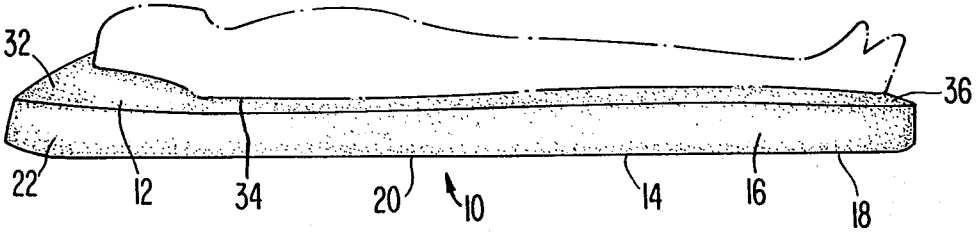
FIG. 1 is a side perspective view of the flotation mattress of the present invention.

The novel flotation mattress of the present invention indicated generally at 10 includes an elongate top panel 12 which is spaced from a similarly shaped elongate bottom panel 14. The top and bottom panels are joined together by a side panel 16 which extends around the periphery of the mattress and is joined to the top panel by an upper peripheral seam 18 and to the bottom panel by a lower peripheral seam 20. The top, bottom and side panels may be constructed of any material commonly used in the formation of flotation mattresses, such as vinyl or nylon bonded to vinyl. The various seams which join portions of the flotation mattress together may be formed by electronic heat sealing or welding, or other suitable joining methods which will create a strong, waterproof structure.

The flotation mattress 10 is internally divided into three sections 22, 24, and 26 by transversely extending interior panels 28 and 30. The section 22 forms a head section for the mattress while the section 26 forms a foot section. Section 24 is an intermediate section between the head and foot sections and extends for substantially twice the length of the head and foot sections. It should be noted that the interior panels 28 and 30 are each formed from two oppositely disposed C-shaped sections **28*a*, 28*b* and 30*a* and 30*b*. These C-shaped sections are relatively spaced and are joined to the top and bottom panels 12 and 14** of the flotation mattress. Each pair of C-shaped panels forms an I-beam construction which impart support to the mattress at the joinder line between mattress sections, but which permits the mattress to pivot upwardly in the area between a pair of C-shaped panels. Thus, the mattress conforms to the pivotal head and foot sections of a conventional hospital bed and will easily pivot to a position conforming with the position of the hospital bed. Also, the mattress can be easily folded and moved to new locations.

Figure 2:
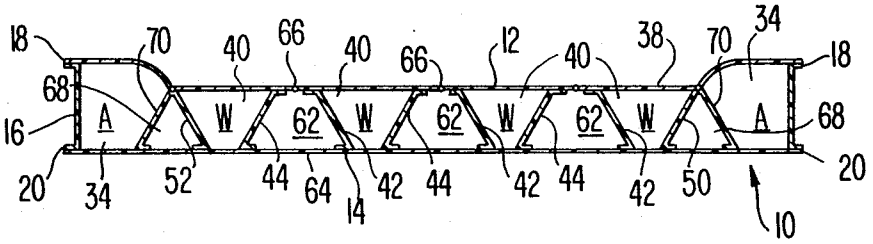
FIG. 2 is a transverse sectional view of the flotation mattress of FIG. 1.
Figure 3:
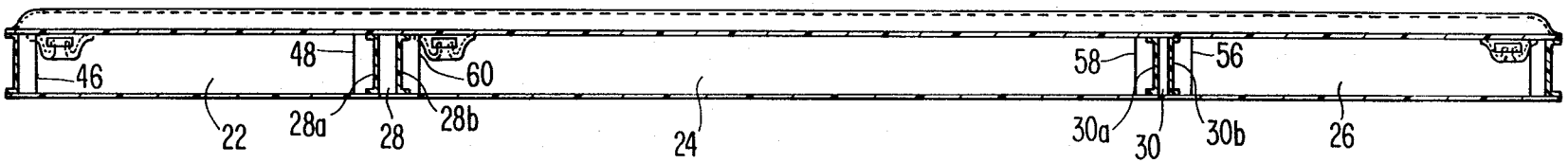
FIG. 3 is a longitudinal sectional view of the flotation mattress of FIG. 1.
Figure 4:
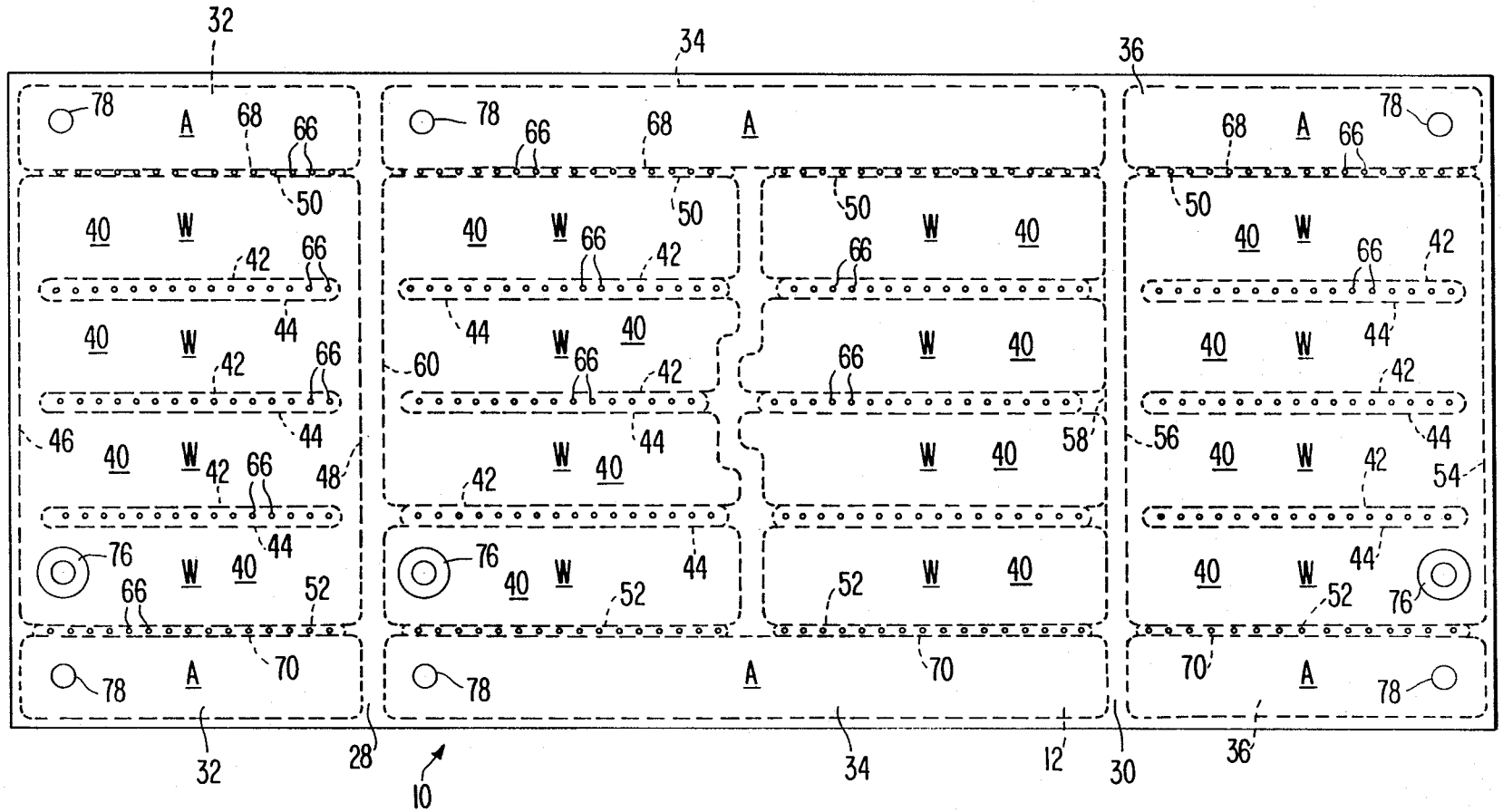
FIG. 4 is a top plan view of the flotation mattress of FIG. 1 with the internal mattress structure shown in broken lines.
Figure 5:
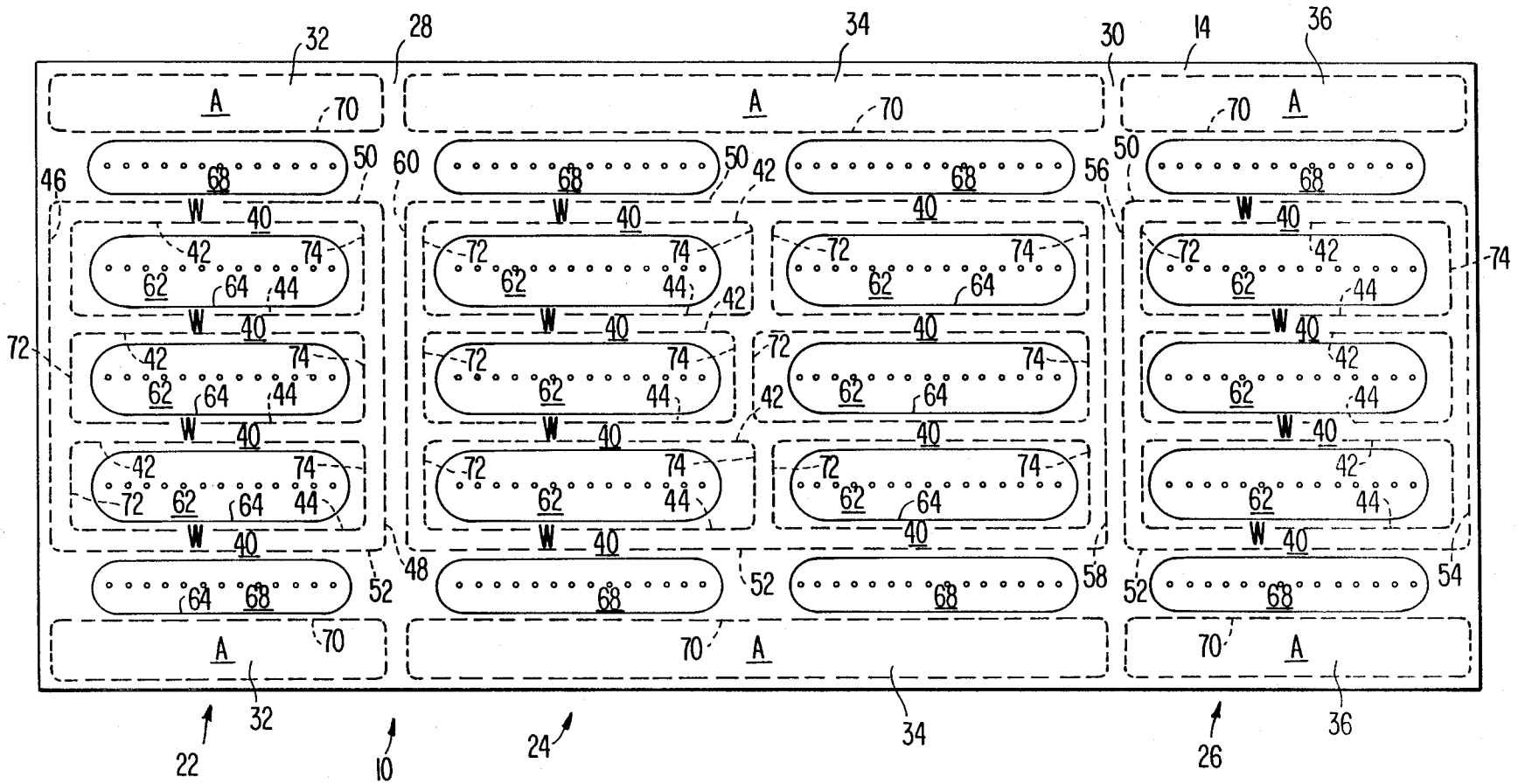
FIG. 5 is a bottom plan view of the flotation mattress of FIG. 1 with the internal mattress structure shown in broken lines.

With reference to FIGS. 2, 4 and 5, it will be noted that the head section 22, middle section 24 and foot section 26 of the flotation mattress 10 are bounded by spaced, longitudinally extending air baffles indicated by the letter A. Thus, the head section includes a pair of spaced air baffles 32, the middle section a pair of spaced air baffles 34, and the foot section a pair of spaced air baffles 36. Each air baffle terminates before it reaches an interior panel 28 or 30 to permit bending of the flotation mattress. It will be noted from FIG. 2 that the air baffles extend upwardly along the longitudinal sides of the mattress 10 and above the top surface of a central portion 38 of the mattress. This central portion includes water and ventilation chambers to be subsequently described. As will be noted from FIG. 1, the upwardly extending air baffles cradle a patient supported by the mattress in the central portion 38, and prevent the patient from rolling off the mattress.

In each of the mattress sections 22, 24 and 26, the central portion 38 of the mattress is formed by alternating water columns and ventilation chambers which extend longitudinally and alternate across the width of the mattress. The water columns, which are indicated by the letter W, are indicated at 40 in FIG. 2 and are substantially V-shaped in configuration. Each water column is bounded by inclined sidewalls 42 and 44 which angle outwardly from a line of attachment with the bottom panel 14 to a line of attachment with the top panel 12. Thus, the water column defined by the sidewalls 42 and 44 is of minimum width in the area adjacent the bottom panel and is of greatest width at the area beneath the top panel of the flotation mattress 10.

As will be noted from FIGS. 4 and 5, all of the water columns 40 in each of the mattress sections are interconnected, so that all may be filled from a single fill spout for the section. Thus, in the head section 32, the inclined sidewalls 42 and 44 which define each water column stop short of end walls 46 and 48. These end walls are watertight walls which extend between the top panel 12 and the bottom panel 14 and are formed integrally with sidewalls 50 and 52. The sidewalls 50 and 52 are inclined outwardly from the bottom panel 14 toward the top panel 12 to complete the end water columns 40 in each of the mattress sections.

Like the head section 22, the foot section 26 and middle section 24 also include closed conduits between the water columns 40. In the foot section, end walls 54 and 56 join with inclined sidewalls 50 and 52 to form a closed water section, while in the middle section 24, end walls 58 and 60 similarly join with sidewalls 50 and 52. The end walls 58 and 60 define two rows of water columns rather than the single row incorporated in the head and foot sections.

Referring again to FIG. 2, it will be noted that the inclined sidewalls 42 and 44, as well as the end walls 50 and 52, not only define the water columns 40 but also define intervening ventilation chambers 62. Like the water columns 40, the ventilation chambers 62 extend longitudinally of the flotation mattress 10 between the water columns. The ventilation chambers are substantially the same size as the water columns but are in an inverted relationship with the narrowest portion of the ventilation chamber being adjacent the top panel 12 and the widest portion being adjacent the bottom panel 14. The ventilation chambers are completely separate from the water columns 40 and open through the bottom panel 14 as indicated at 64. Also, the ventilation chambers communicate with the atmosphere through rows of holes 66 which extend through the top panel 12 into each ventilation chamber.

Smaller ventilation chambers 68 are formed on opposite sides of each mattress section to extend between the inclined end walls 50 and 52 and inclined inner walls 70 for each of the air baffles 32, 34 and 36. The smaller ventilation chambers 68 are substantially identical in construction to the larger ventilation chambers 62 and include bottom openings 64 as well as small vent holes 66.

With reference to FIG. 5, it will become apparent from the broken lines which disclose the water path between the water columns 44 in each mattress section that all such water columns in a mattress section are interconnected. Also, it will be noted that each ventilation chamber is completely closed off from the path of water flowing through a respective mattress section. Thus, each ventilation chamber 62 is closed by two end walls 72 and 74 which extend between the sidewalls 42 and 44. In the head section 22 of the flotation mattress 10, the end walls 72 and 74 are spaced from the end walls 46 and 48, respectively, to create a connecting passageway between the various water columns 40. Similarly, in the foot section 26, connecting passages are formed by the end walls 72 and 74 being spaced from the end walls 56 and 54, respectively.

In the middle section 24 of the mattress 10, the outermost end walls 72 and 74 for each pair of ventilation chambers 62 are spaced from the end walls 60 and 58, respectively, while the innermost end walls 72 and 74 of each pair of ventilation chambers are spaced from each other. This creates water flow passages both along the outer edges of the middle section connected to each of the water columns 40, as well as a water passage through the center portion of the middle section which connects to each water column.

The water columns 40 in each section of the flotation mattress 10 may be filled with water or drained through a suitable fill spout assembly 76 communicating in each section with one of the water columns 40. Air under pressure is provided to each of the air baffles 32, 34 and 36 by a suitable air valve 78 associated with each individual air baffle. The water columns 40 can, in some instances be filled with other fluids or materials such as air or gel. Some such materials may reduce the weight reduction characteristics of the mattress to a great extent, but the superior flexibility and ventilation advantages are retained.

Industrial Applicability

The flotation mattress 10 of the present invention is designed for use with bedridden patients in homes, hospitals and nursing homes to prevent and assist in the healing process of decubitus ulcers. The novel sectional construction of this flotation mattress with the internal alternating water columns and ventilation chambers assures that the weight of the mattress is minimized while the water support provided to the patient is maximized. The open ventilation chamber construction combined with the ventilation holes 66 assures that air is pumped under the mattress and also through the ventilation holes and beneath the patient. Air circulation is enhanced by the pumping action occasioned as the patient shifts on the mattress causing expansion of the water columns and compression of the adjacent ventilation chambers to force air through the ventilation holes 66. This pumping action is facilitated by the inclined sidewalls for the water columns which also constitute the sidewalls for the ventilation chambers. The air baffles on either side of the mattress cradle the patient within the center portion of the mattress to assure that the patient does not roll off, while the sectional construction of the mattress permits it to flex with a hosptial bed when the bed is moved to the raised position.

What is claimed is:

1. A floatation mattress comprising an outer cover means formed to define an enclosed inner area, said outer cover means including an upper panel and a lower panel extending in spaced relationship to said upper panel, means mounted within said enclosed inner area to form water compartment means for receiving and containing water and ventilation chamber means separate from said water compartment means, said means to form said water compartment means and ventilation chamber means including inclined, spaced sidewalls which are secured to said upper and lower panels and which extend therebetween, each water compartment means including a pair of said inclined spaced sidewalls which incline outwardly away from one another from said lower panel to said upper panel, the cross-sectional area of each such water compartment means being greater adjacent said upper panel than is the cross-sectional area of said water compartment means adjacent said lower panel, and openings formed in said cover means in communication with said ventilation chamber means.

2. The flotation mattress of claim 1, wherein wall means are secured between said upper and lower panels within said enclosed inner area, said wall means operating to divide said enclosed inner area into a plurality of sequentially arranged separate sections, each of said separate sections including water compartment means and ventilation chamber means.

3. The flotation mattress of claim 2, wherein the water compartment means in each said separate section are interconnected, each such separate section including a single spout means mounted on said outer cover means and communicating with said interconnected water compartment means.

4. The flotation mattress of claim 1, wherein said water compartment means and ventilation chamber means are alternately arranged across said inner area.

5. The flotation mattress of claim 1, wherein openings are formed in both said upper and lower panels for communication with each such ventilation chamber means.

6. The flotation mattress of claim 1, wherein air baffle means are formed along opposite sides of said enclosed inner area, said air baffle means being operative to receive air under pressure and to expand in response to the receipt of such air to raise portions of said upper panel above the plane of the remainder of said upper panel.

7. The flotation mattress of claim 1, wherein said means to form said water compartment means and ventilation chamber means relative space said water compartment means across said inner area with said ventilation chamber means filling the area between spaced water compartment means, the inclined spaced sidewalls for said water compartment means forming inclined spaced sidewalls for each intermediate ventilation chamber means, the cross-sectional area of each such ventilation chamber means being greater adjacent said lower panel than is the cross-sectional area of said ventilation chamber means adjacent said upper panel.

8. The flotation mattress of claim 7, wherein dividing wall means are secured between said upper and lower panels within said enclosed inner area, said dividing wall means operating to divide said inner area into sequentially arranged separate sections, each of said separate sections including water compartment means and intermediate ventilation chamber means arranged alternately across said section.

9. The flotation mattress of claim 8, which includes air baffle means formed along opposite sides of said enclosed inner area within each of said sequentially arranged sections, said air baffle means being operative to receive air under pressure and to expand in response to the receipt of such air to raise portions of said upper panel above the plane of the remainder of said upper panel.

10. The flotation mattress of claim 9, wherein openings are formed in both said upper and lower panels in communication with each such ventilation chamber.

11. The flotation mattress of claim 10, wherein the water compartment means in each said separate section are interconnected.

12. The flotation mattress of claim 11, wherein each such ventilation chamber communicates with at least one large opening in said lower panel and with a plurality of small spaced openings in said upper panel, said small spaced openings extending beside and in spaced relation to at least one adjacent water chamber.

13. The flotation mattress of claim 12, wherein said dividing wall means is formed of spaced C-shaped panels arranged in an I-beam configuration.

14. The flotation mattress of claim 13, wherein each separate mattress section includes a single spout means mounted on said outer cover means and communicating with the interconnected water compartment means in said section.

15. A floatation mattress comprising an outer cover means formed to define an enclosed inner area, said outer cover means including a lower panel and an upper panel extending above said lower panel, means mounted within said enclosed inner area to form spaced water compartments for receiving and containing water and noninflatable ventilation chamber means separate from said water compartments, including inclined spaced sidewalls which are secured to said upper and lower panels and which extend therebetween, each water compartment including a pair of said inclined spaced sidewalls which incline outwardly away from one another from said lower panel to said upper panel, the cross-sectional area of each such water compartment being greater adjacent said upper panel than is the cross-sectional area of said water compartment adjacent said lower panel, the inclined spaced sidewalls for said water compartments forming inclined spaced sidewalls for said ventilation chamber means positioned intermediate two adjacent water compartments, the cross-sectional area of such ventilation chamber means being greater adjacent said lower panel than is the cross-sectional area of said ventilation chamber means adjacent said upper panel, and means interconnecting a plurality of said water chambers.

16. A floatation mattress having a longitudinal axis and comprising an outer cover means formed to define an enclosed inner area, said outer cover means including an upper panel and a lower panel extending in spaced relationship to said upper panel, means mounted within said enclosed inner area to form a plurality of water compartment means for receiving and containing water and a plurality of ventilation chamber means separate from said water compartment means, said water compartment means and ventilation chamber means extending substantially parallel to the longitudinal axis of said mattress, at least one large opening formed in said lower panel for each said ventilation chamber means to communicate therewith and a plurality of small spaced openings formed in said upper panel for each said ventilation chamber means for communication therewith wherein said water compartment means and ventilation chamber means are alternately arranged across said inner area, and spaced wall means are secured between said upper and lower panels and extending transversely to said longitudinal axis within said enclosed inner area to divide said enclosed inner area into a plurality of sequentially arranged separate sections, each of which includes separate water compartment means and ventilation chamber means.

17. The floatation mattress of claim 16, wherein the separate water compartment means in each said separate section are interconnected, each such separate section including a single spout means mounted on said outer cover means and communicating with said interconnected water compartment means.

18. The floatation mattress of claim 17 wherein each said spaced wall means is formed of spaced panels extending between said upper and lower panels.

* * * * *